US005177309A

United States Patent [19]

Willoughby et al.

[11] Patent Number: 5,177,309

[45] Date of Patent: Jan. 5, 1993

[54] LASER-AIMED WEAPONS SYSTEM

[76] Inventors: Brian D. Willoughby, 7407 Berkshire Dr., Clinton, Md. 20735; Carl W. Roy, II, 9655 Ridgeview Dr., Owings, Md. 20736

[21] Appl. No.: 811,996

[22] Filed: Dec. 23, 1991

[51] Int. Cl.[5] ..... F41G 1/34

[52] U.S. Cl. ..... 42/103; 362/110

[58] Field of Search ..... 42/103, 100, 101; 362/110, 111, 112, 113, 114

[56] References Cited

U.S. PATENT DOCUMENTS

| | | | |
|---|---|---|---|
| 1,610,092 | 12/1926 | Hise | 362/110 |
| 2,450,584 | 10/1948 | Dodge | 362/114 |
| 3,106,348 | 10/1963 | Robinson | 362/110 |
| 4,313,272 | 2/1982 | Matthews | 42/103 |
| 4,758,933 | 7/1988 | Winberg et al. | 362/110 |
| 4,934,086 | 6/1990 | Houde-Walter | 42/103 |

*Primary Examiner*—Michael J. Carone
*Attorney, Agent, or Firm*—John Leonarz

[57] ABSTRACT

A laser beam generating module is disposed at or near the butt end of a handgun in substantial alignment with the gun barrel. The module may optionally include means for activating the laser which are responsive to the horizontal or vertical attitude of the handgun, means for adjusting the aiming module for accuracy at various ranges, and means for suppressing the laser beam until the user of the handgun is ready to use it. A version of the invention places the laser module at the end of a magazine insertable into the handgrip of an automatic handgun so that the laser module is carried just adjacent the butt end of the handgun. Placement of the laser module at the butt end of the weapon yields accuracy adequate for routine police work, does not upset the balance and feel of the weapon, and it enables the weapon to be carried by its user in its conventional holster. Variations of the invention are described such that the laser module is built into the handgrip of the weapon, inserted when attached to a conventional ammunition clip, and attached to the butt end of the weapon by means of a mounting bracket.

8 Claims, 3 Drawing Sheets

LASER-AIMED WEAPONS SYSTEM

BACKGROUND OF THE INVENTION

This invention is in the field of weapons systems, and more particularly in the field of handguns carrying means for generating a laser beam for a sighting mechanism. It is well known in the handgun art to connect means for generating a laser beam aligned to the barrel axis of a handgun as an aid in sighting the weapon to deliver a projectile substantially at the point where the laser beam intersects the target.

Among law enforcement officers the laser sighting devices are highly prized. Confrontations requiring intervention with weapons are rarely outdoors in broad daylight. Most police work which requires the use of handguns occurs in semidarkness either indoors, or outdoors after dark, when the laser stands out very effectively. The bright light, usually red, makes a dramatic and distinct announcement of the place where the bullet can be expected to impact a target, and it has a powerfully intimidating effect. Accordingly, many violators capitulate and cease resistance when the laser beam finds them, thereby reducing the potential for violence in a situation which has required intervention using firearms.

DESCRIPTION OF THE PRIOR ART

The prior art devices are mounted as close to the barrel as possible to provide careful alignment along the expected path of the bullet for targeting to within an inch or so of impact over a considerable range of distances. Obviously a greater range of accuracy will be provided by a laser mounted above the muzzle and inclined slightly downward so as to cross the bullet trajectory at two points, as compared with a mounting below the muzzle which provides a beam either parallel with the axis of the gun barrel or inclined slightly upward, either of which would cross the trajectory only once. By mounting the laser in close proximity to the muzzle of the weapon, the prior art devices have enabled gun users to obtain remarkable accuracies in shooting competitions without the need for painstaking visual alignments along the mechanical sighting mechanisms of the weapon.

From the point of view of a law enforcement officer, an operational difficulty with the prior art laser sighting devices is the fact that they have employed mechanisms for mounting the laser beam generating means in the close vicinity of the gun barrel, even though this achieves high degrees of accuracy. These mechanisms have added weight and bulk to the handgun at locations which render the operation of the weapon awkward and difficult. The weight of such devices upsets the balance of the handgun and tends to throw off the natural feel of the weapon in the hands of its user. Operational control of such devices typically requires an extension along the exterior of the weapon of a wire conductor to some kind of switch in the vicinity of the handgrip to enable the laser to be selectively activated and deactivated by the same hand which holds the weapon. The addition of the wire and switch apparatus not only defaces the clean outlines of the weapon, but also tends to interfere with the user's natural grip.

The size and bulk of the prior art devices preclude their being inserted into ordinary gun holsters and therefore severely restrict the availability of the weapons so equipped for routine use by law enforcement officers. The typical holster is designed, or is chosen, to fit snugly to the outlines of a particular weapon. The main consideration is to preclude the weapon from shifting about during movements of its wearer. Some holsters are custom made for particular handguns. Given the design considerations of holsters, it is clear that a handgun equipped with a laser-aiming device adjacent the weapon's barrel cannot be carried in ordinary holsters, and accordingly would be of little use to a law enforcement officer in most situations.

Additionally, the kits in the market for adding the laser beam sighting capability to existing police weapons may void the warranty on such weapons and often involve significant modifications, which, for safety and liability reasons, are mostly prohibited by departmental regulations in most police departments.

It is known to attach a conventional flashlight at the butt of a handgun, to illuminate the general target area. A user report on such a device, Lydecker, "When Things Go Bump in the Night," was published in the July 1991 issue of *Guns* magazine, pp. 26, et seq.

DESCRIPTION OF THE INVENTION

Our invention overcomes these difficulties by placing a laser diode in a mounting device positioned at the butt end of the handgrip portion of the frame. Unlike the prior art devices this mounting, so remote from the axis of the barrel, would give only a rough approximation of the bullet's point of impact over a large range of distances. Nevertheless the accuracy is adequate for most uses in law enforcement. Weapons incorporating our invention have the advantage that they can be carried conveniently in conventional and familiar gun holsters, and are therefore readily available for immediate use by the officer. Targeting within two or three inches of impact, especially when the margin is measured vertically against a vertical target, such as an active criminal, is quite sufficient in most law enforcement work. It is unusual for an officer to have to engage his handgun in an action over 50 feet away, and the more common distance is in the range of 10 to 30 feet.

Since the balanced feel of the weapon in the hands of its user is a function of the weight of the barrel and firing mechanism relative to the owner's grasping point, the handgrip, these being above and slightly forward of the handgrip, our very light weight laser sight extension positioned below the handgrip has only the most minimal effect upon the balance and feel of the weapon. This is because our laser mechanism is of miniaturized electronics and is mounted close to the grasping point. The combination of light weight and close proximity to the user's hand grasping point minimizes the amount of leverage imposed by the device, and therefore keeps any sense of imbalance to a minimum.

While our invention may be incorporated into the original design of a handgun, it is also within the scope of our invention to provide an add-on device to be attached to the butt, or distal, end of the handgrip. This add-on mounting may be in the form of a simple attachment to the butt, or, in the case of the popular weapons having a bullet magazine slidably secured within the handgrip, our invention can be manufactured as an extension of the magazine. Thus, by sliding out the old magazine and sliding in the new one containing the laser device, the laser sighting feature can be added to a familiar weapon without the drawbacks associated with the conventional laser sighting mechanisms. Since many law enforcement officers use this type of weapon, they are accustomed to carrying several interchangeable magazines on their belts to permit quick field conversion or reloading of their weapons. Thus, the placement of a laser mount at the bottom of the magazine provides a means for convenient conversion to laser-aiming, which is ergonomically familiar to law enforcement officers.

An officer suddenly confronted with a hostile and life threatening situation has the following four step protocol when using a conventional laser-aimed weapon: (1) draw the weapon, (2) activate the laser, (3) aim and, if necessary, (4) fire. An optional feature of our invention is an insertion, into the control circuit of the laser, of a switch which is responsive to the attitude of the weapon so as to be automatically activated when the weapon is levelled at a target, and deactivated when it is not, e.g. when it is substantially vertical in a belt holster. This feature, which is most commonly realized with a mercury switch, eliminates an entire step from the officer's check list of activities needed to bring his weapon into action against a perpetrator.

Many switches for laser-aimed weapons are activated by pressing a button to close the contacts necessary to turn the laser on. The default position of the laser is "off." The barrel mounted varieties discussed above typically are configured in that way. Over time a user's experience with a particular weapon causes the user to develop a smooth working relationship with the weapon. Effective shooting is promoted by the familiar feel of the weapon as the handgrip is taken by three fingers opposed by the user's thumb. It is awkward and distracting to have to use one of the gripping fingers to activate the laser. The impulse to pull the trigger, which normally is implemented without physical displacement of the barrel, may impart an unexpected twist to the weapon when one of the gripping fingers has to hold the laser activator button, thereby throwing the bullet off its intended course.

A useful variation on our invention is an interrupt switch which may optionally be included in the circuitry. It is configured so that when the button is held down, the contacts are separated, interrupting power to the laser, so that the default position is to have the laser "on". In a potential confrontation an officer can have the weapon in hand in the ready mode in all respects except that by having the interrupt switch active, the laser is suppressed. The officer's position is therefor not disclosed by the laser beam. If the confrontation takes an unfortunate turn so that the officer must consider imminent discharge of the weapon, release of the switch activates the laser and eliminates an element to be thought about during the actual confrontation. With the conventional switch, the button must be depressed, which adds a concern instead of eliminating one. With the laser on, the officer's grip on the weapon is normal and familiar, so that discharge of the weapon can be expected to propel the bullet along its expected trajectory.

The point at which the laser beam would cross either the axis of the gun barrel or the expected trajectory of a bullet, would be largely a function of the angle of the laser generating diode relative to the barrel axis. By mounting the diode pivotably for rotation relative to the barrel axis, our laser-aiming device optionally can be preset for maximum accuracy at a predetermined range. Thus, for an encounter at a 30 foot distance one might preset the diode at a relatively shallow angle, and for a 15 foot distance the preset would be at a steeper angle.

Accordingly, it is an object of our invention to provide an effective laser sighted handgun for use in law enforcement.

It is another object of our invention to provide an operationally superior mounting means for laser sighting devices on handguns.

It is yet another object of our invention to provide a handgun weapons system including a laser sighting mechanism, which is capable of being routinely carried in conventional holsters, readily available for instant use by law enforcement officers, when suddenly presented with situations requiring the availability of firearms.

Still another object of our invention is to provide a means for convenient retrofit onto a conventional handgun, of a laser sighting attachment.

It is a further object of our invention to provide a lightweight retrofit laser sighting mechanism for a handgun which does not significantly interfere with the natural balanced feel of the weapon in the hand of the owner.

Yet another object of our invention is to provide a means for suppressing the laser when the weapon is being carried in its normal vertical position in a belt holster while inactive, but which turns on automatically when the weapon is raised to the horizontal, potentially active, position.

A further object of our invention is to provide a laser-aimed weapon which turns on and off automatically in accordance with the direction in which it is aimed, thereby eliminating the necessity to think about activating the laser when bringing the weapon into action.

It is another object of our invention to provide a laser-aimed handgun configured with a switch operable by a single one of the user's hands, which defaults to the "on" position, thereby leaving the user free to concentrate upon the situation in which the user is involved.

Still another object of our invention is to provide a laser-aimed handgun with means for presetting the laser's position to yield maximum accuracy at a predetermined range.

DESCRIPTION OF THE PREFERRED EMBODIMENT

Figure 1:
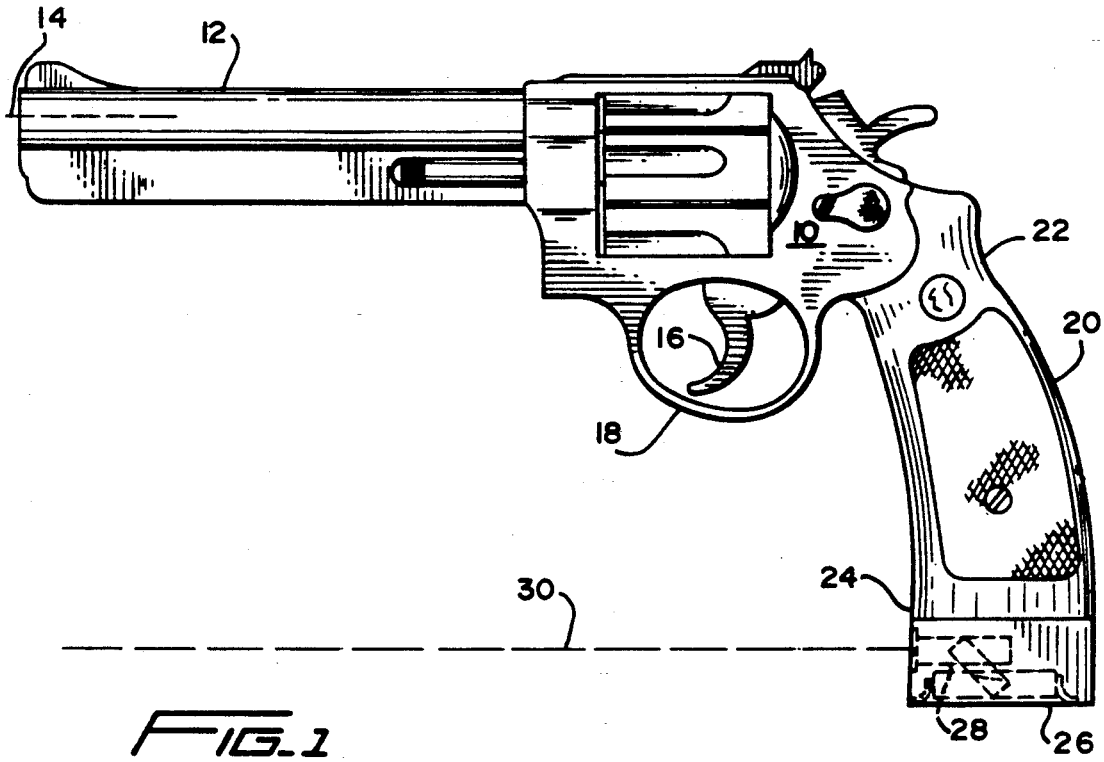
FIG. 1 is a side view of a revolver type handgun incorporating a laser-aiming module built into the butt end of the handgrip.

The preferred embodiment of our laser-aimed weapons system invention is shown in FIG. 1, in which a conventional handgun 10 includes a barrel portion 12 which is aligned along a longitudinal axis 14. The handgun 10 further includes a trigger 16 which is surrounded by a trigger guard 18, both of which are disposed conveniently adjacent a handgrip 20 to accommodate a human hand in grasping the handgun, with the palm and three fingers enclosing the handgrip while the extended index finger can comfortably engage the trigger.

Relative to the central portion of the handgun 10, the handgrip 20 has a proximal end 22 and a distal end, or butt 24. Either built into the distal, or butt end 24 of the handgrip, or immediately adjacent to it, is a laser assembly 26 featuring a laser diode 28, which is carefully aligned to project the laser beam 30 substantially parallel with the barrel axis 14 so as to illuminate the point of expected impact of a bullet fired from the handgun.

In use, the laser beam 30, when aligned substantially parallel with the barrel, impinges upon an intended target at a point within about 3 inches from a point where an extension of the barrel axis 14 would strike the target. Assuming the handgun is being fired with the gun in its normal, vertical plane, as defined by the intersection of the axes of the barrel and the handgrip, the force of gravity sends the bullet along a predetermined trajectory tending downward, toward the point on the target illuminated by the laser beam.

Accordingly the user of the gun may be assured of hitting very close to a point marked on the target by the laser beam 30, and the user is therefore freed from any requirement to aim along sights provided on the gun barrel. It is not necessary to raise the weapon to shoulder level, and in fact the perspective in viewing the target, which is afforded to the user by the fact that the user's eyes and the laser beam are not coaxial, actually improves the user's ability to gauge the desirability of one possible shot as compared with another, especially since the user is able to aim with both eyes instead of only one.

Figure 2:
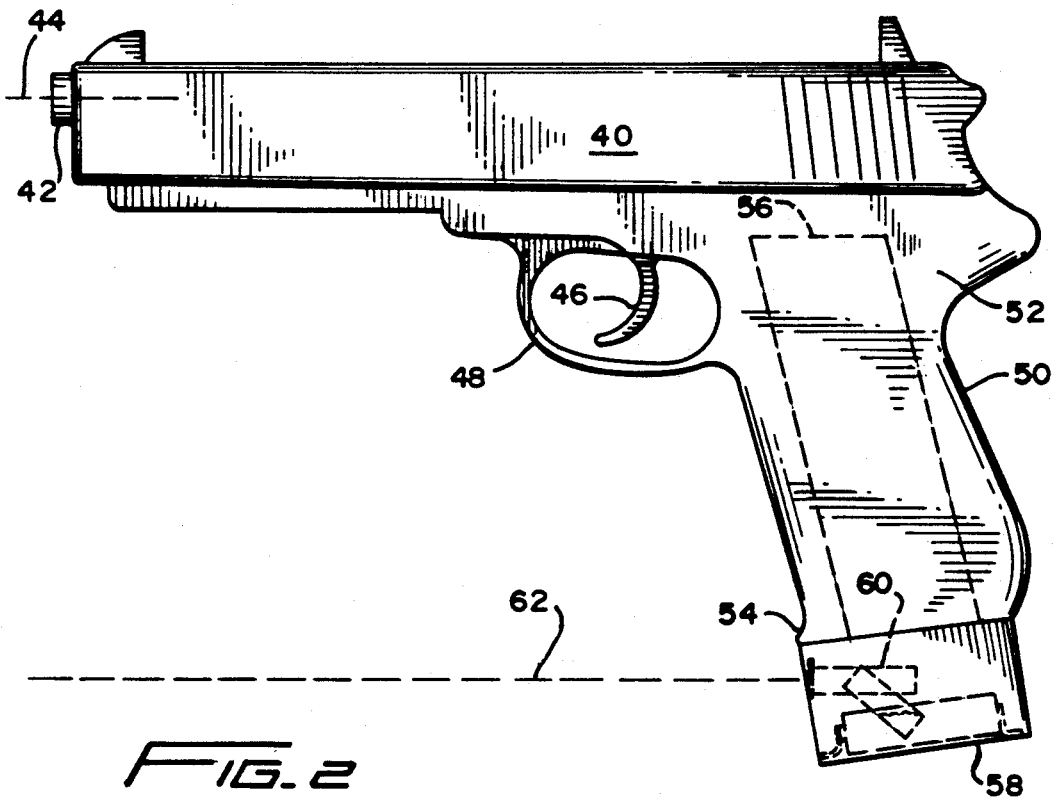
FIG. 2 shows an automatic handgun with an insertable ammunition magazine incorporating the laser-aiming module of our invention.

In FIG. 2 is depicted an automatic handgun 40 which includes a barrel 42 which has a longitudinal axis 44. A trigger 46 is enclosed by a trigger guard 48. The handgun 40 has a handgrip 50 which, relative to the main body of the handgun 40, has a proximal end 52 and distal end, or butt, 54. Unlike the handgun 10 of FIG. 1, the automatic handgun 40 includes a slidably demountable ammunition magazine 56 which is insertable through the butt end 54 of the handgrip 50 to feed bullets as needed into the firing system of the handgun.

In a conventional automatic weapon, the magazine 56 has an endplate which fits snugly adjacent the butt end 54 of the handgrip 50, but in our invention the endplate is expanded into a laser module 58 which includes a laser diode 60, which projects a laser beam 62 aligned to be substantially parallel with the longitudinal axis 44 of the barrel 42. When inserted by fully conventional means into the handgrip of the weapon 40, the magazine 56 makes its intended connection with the internal works of the weapon and operates in a fully conventional manner. The laser module is disposed at the external end of the demountable magazine, however, so as to protrude, when mounted, below and beyond the butt end of the weapon proper, spatially in the same location relative to the weapon as the laser module described above with reference to FIG. 1. In use, the weapons system incorporating the demountable magazine version of our invention operates substantially as does the system described with reference to FIG. 1.

The special value of the demountable magazine version of our invention is that it enables the user to have available a swift, convenient and simple means for converting a conventional automatic handgun into a laser-aimed weapon by the straightforward and familiar means of interchanging magazines. Since law enforcement officers routinely carry a plurality of interchangeable magazines on their holster belt, the fact that one of them incorporates a laser module does not introduce an unfamiliar element to their routine.

Figure 3:
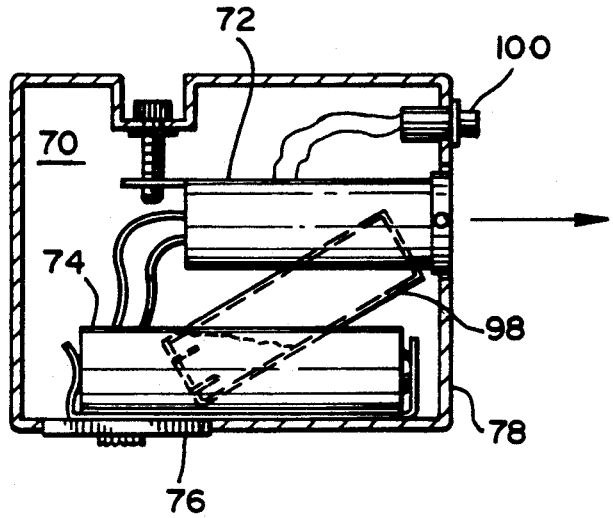
FIG. 3 is a cutaway side view of the laser-aiming module of our invention.
Figure 4:
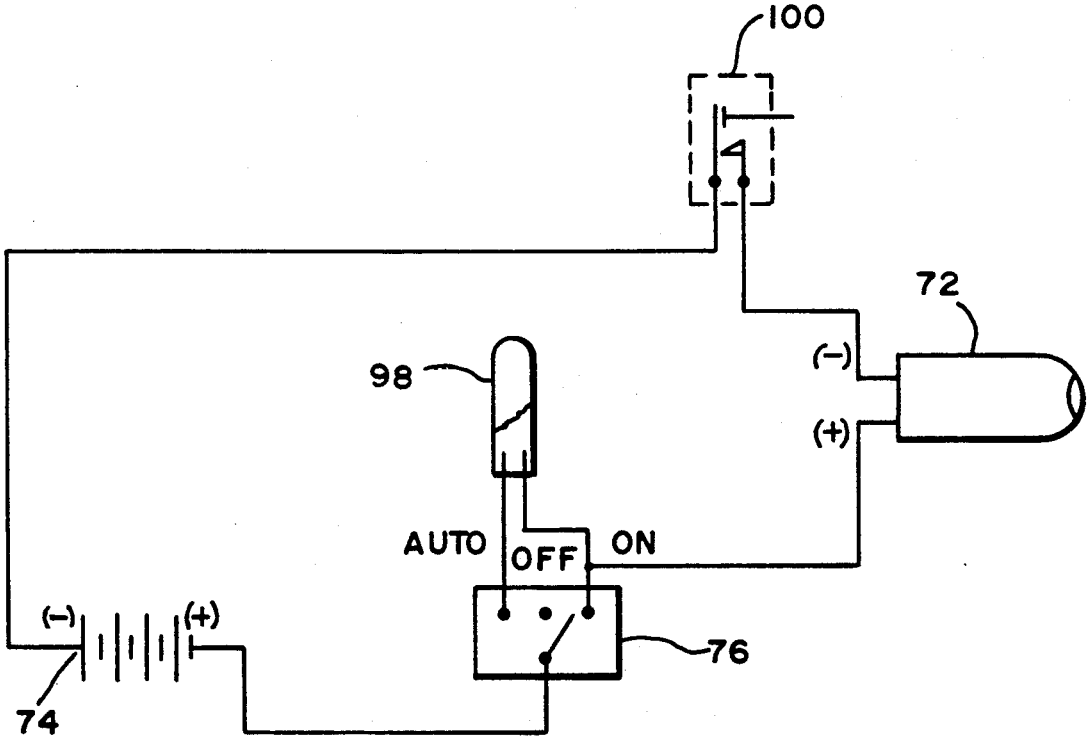
FIG. 4 is a wiring diagram of the laser-aiming module of our invention.

With reference to FIGS. 3 and 4, it may be seen that the laser module 70, corresponding to the laser modules 26 and 58 described above with reference to FIGS. 1 and 2, respectively, contains a laser diode 72, which is a VLM2-5(ALS) laser module. It is connected in a circuit with a battery 74, which is a 7VDC battery, Duracell model TR175, and a switch 76, which may be a simple on-off slide switch, or in our preferred embodiment, an SPDT, Center off, sub miniature slide type switch.

Figure 5:
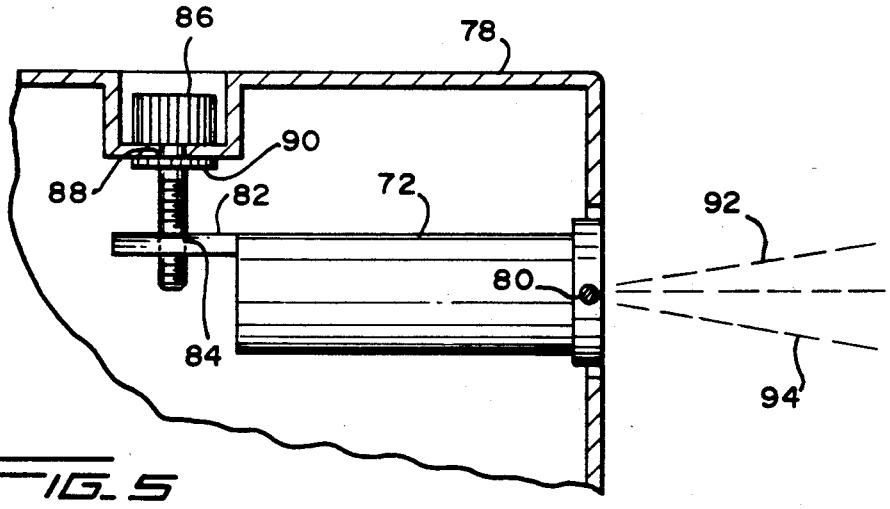
FIG. 5 is a cutaway view of a portion of the laser module of our invention showing means for adjusting the angle of the laser beam.

In FIG. 5, the laser diode 72 is shown mounted within the laser module housing 78 by pivot pins 80. An extension 82 of the laser diode 72, defines a threaded aperture 84, through which the threaded portion of set screw 86 is received. The set screw 86 passes through the aperture 88 in the laser module housing 78, and it is retained in position by the "C" clip 90. As the set screw 86 is rotated it raises or lowers the extension 82 and the laser diode 72 to which it is attached, pivoting the diode 72 about the pivot pins 80. The pivot action enables the laser beam to be directed to positions varying from a high position 92, by infinitely variable intermediate positions to a lower position 94. In the high position 92, the laser beam would intersect the trajectory of a bullet fired from the handgun at a point nearer to the user than when the beam is at a lower position such as the position 94. With calibration of several settings by actual firings against stationary targets of known distance, the user can establish a plurality of settings, which, for a given type of bullet, will yield high accuracy at corresponding predetermined ranges.

It will be clear to those skilled in the art that the minimum practical version of our laser module would consist of the laser diode 72 connected in a circuit with the battery 74 and a minimal on-off slide switch 76 to enable selective operation of the unit.

We have determined that there ar additional useful features, however which enhance the operation of our weapons system. Thus, there may be provided a mercury switch 98, operable through the automatic setting of the switch 76 as shown in FIG. 4. The mercury switch 98 is mounted in an orientation angled relative to the vertical so that when the weapon is holstered, in a substantially vertical position, the electrical contacts are unconnected because they are above the mercury. No current flows through the mercury and the laser is off. When the weapon is drawn, however, ready for use in a horizontal position, the mercury has flowed over the electrodes as shown in FIG. 3, thereby closing the circuit, and automatically turning on the laser.

It is anticipated that the officer using the weapons system would normally carry the weapon with the switch 76 in the off position, thereby precluding accidentally turning the laser on and wasting the power in the battery. When the officer is responding to a call, the switch would be advanced to the automatic position so as to permit the activation of the laser diode 72 to be governed by the position of the weapon relative to the vertical.

An additional optional feature is the conventional plunger interrupt switch 100 which is located at the top of the laser assembly 70 so as to be operable by the officer's little finger as the hand grips the handgrip of the weapon. It may not be desirable for the laser to be on during the early part of a confrontation until the officer is ready to fire, since the laser beam discloses the officer's position. Accordingly the interrupt switch gives the officer the option to close the circuit by releasing the plunger, thereby activating the laser when it becomes necessary.

Figure 6:
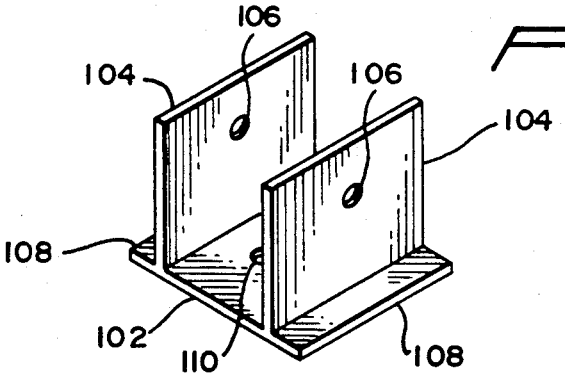
FIG. 6 is a perspective view of a mounting bracket for attachment to a revolver or similar type of weapon for mounting of a laser module to that kind of weapon.

The laser aiming system of our invention can be retrofit onto existing revolver type weapons and other nonautomatic guns. FIG. 6 shows a mounting bracket which may be installed on the butt of a conventional nonautomatic weapon. From the baseplate 102 there extend two upright members 104 in which are defined apertures 106. The baseplate 102 extends beyond the members 106 to include flanges 108. In the middle of the baseplate 102 there is provided a conventional, resilient detent 110.

Figure 7:
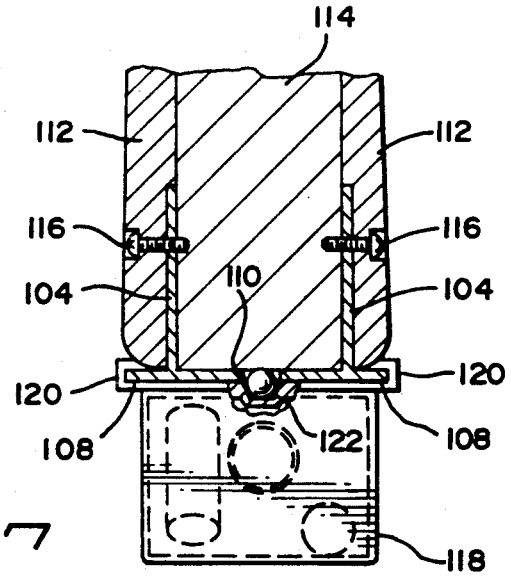
FIG. 7 is a cutaway view of the base of a handgrip of a revolver equipped with a mounting bracket and having a laser module of our invention attached thereto.

The mounting bracket is shown installed in FIG. 7, where grips 112 have been removed and reassembled upon the main handgrip member 114 of a conventional nonautomatic weapon, by removal and replacement of the grip screw 116. The upright members 104 are inserted around the main handgrip member 114 and secured in place by replacement of the grips 112 and the grip screws 116.

A detachable laser module 118, which is in all operational respects identical to the unit described above with respect to FIG. 3, is slidably attached to the weapon by the slide portions 120 which snugly fit the flanges 108 of the mounting bracket. The module 118 is held longitudinally in place on the mounting bracket by interaction between the detent 110 and the cavity 122 defined in the top of the housing of the module 118.

Thus it may be seen that our invention provides a useful and effective laser-aiming feature with little or no modification of conventional handguns, and which is mounted on the weapon in such a way as to leave the barrel and operating superstructure of the weapon uncluttered so that the weapon fits into conventional holsters as conveniently with the module in place as it would without the module. Moreover, the placement of the laser module at the butt end of the handgrip, close to the place on the weapon where the user grips it, presents only the most minimal effect to the user on the way the weapon feels in the user's hand.

We claim:

1. A laser-aimed weapons system, comprising a handgun having a barrel aligned along a longitudinal axis, a handgrip connected to said barrel and including a proximal portion of said handgrip adjacent said barrel, and a distal portion of said handgrip, and a small, lightweight, diode-type laser transmitter disposed within said distal portion of said handgrip, said small, lightweight, diode-type laser transmitter aligned for projecting a laser beam at an angle to said axis of said barrel, said angle being chosen to cause a beam from said laser to intersect said longitudinal axis of said barrel at a distance in the front of said handgun in the range of ten feet to infinity.

2. A laser sighting attachment for a handgun having a barrel and a handgrip including a butt end, comprising housing means, including means for disposing said attachment adjacent said butt end of said handgrip, and laser diode means within said housing means for generating a laser beam oriented to a course substantially parallel with a longitudinal axis of said barrel of said handgun.

3. The laser sighting attachment of claim 2 wherein said means for disposing said attachment adjacent said butt end of said handgrip includes means for affixing said housing directly to said butt end of said handgrip.

4. The laser sighting attachment of claim 2 wherein said means for disposing said attachment adjacent said butt end of said handgrip includes means mountably insertable within said handgrip.

5. A small, lightweight, diode-type laser sighting device for a handgun having a handgrip having a butt end, comprising:

means for attaching said laser sighting device at said butt end of said handgun in alignment with a longitudinal axis of a barrel of said handgun, and circuit means comprising:

a power source, diode-type laser generating means including beam directing means for aligning a beam from said diode-type laser generating means in the direction of said longitudinal axis of said barrel of said handgun, and switch means responsive to verticality of said longitudinal axis of said barrel of said handgun for activating said laser generating means to generate a beam from said laser.

6. A laser-aimed weapons system comprising:

A handgun having a barrel and a handgrip, each of said barrel and said handgrip having a longitudinal axis and said axes intersecting to define a plane of said handgun, said handgun being configured to propel a bullet when said handgun is discharged in a substantially vertical plane of said handgun, with said barrel of said handgun substantially level, along a predetermined trajectory through said plane of said handgun, said handgrip including a butt end positioned distant from said barrel and having small, lightweight, diode-type laser generating means disposed at said butt end, said small, lightweight, diode-type laser generating means aligned relative to said predetermined bullet trajectory to project a laser beam to intersect said bullet trajectory.

7. A laser sighting mechanism for attachment to a handgun capable of throwing a bullet along a predictable trajectory, said handgun including a handgrip having a butt end, comprising a housing, means for attaching said housing to said butt of said handgun, said housing being configured to form a short extension of said handgrip, diode-type laser generating means adjustably disposed within said housing to project a laser beam substantially in the direction of said bullet trajectory, means for adjusting said diode-type laser generating means for projecting said laser beam for convergence with said trajectory at a predetermined distance from said handgun.

8. A small, lightweight diode-type laser sighting mechanism for attachment to a handgun having a barrel and a handgrip with a butt end, comprising:

means for attaching said mechanism adjacent said butt end of said handgrip, small, lightweight diode-type laser means for projecting a laser beam in the direction of said barrel, a power source engaged for activating said laser beam, and means operable manually by a user of said handgun for interrupting said projection of said laser beam, said manually operable means being manually releasable for restoring said projection of said laser beam.

* * * * *